United States Patent [19]

Garduno

[11] Patent Number: 4,796,314

[45] Date of Patent: Jan. 10, 1989

[54] PORTABLE INFANT FURNITURE

[76] Inventor: Stephanie Garduno, 33811 Oldbridge Rd., Dana Point, Calif. 92629

[21] Appl. No.: 945,376

[22] Filed: Dec. 22, 1986

[51] Int. Cl.[4] ..... A47D 7/00

[52] U.S. Cl. ..... 5/98 A; 108/118; D6/429; 248/164; 5/93 R

[58] Field of Search ..... 5/98 A, 93 R, 174, 99 R; D6/360, 361, 491, 371, 372, 373, 374, 375; 297/45, 46; 108/118; 248/188.9, 188.8, 188.6, 431, 164, 166

[56] References Cited

U.S. PATENT DOCUMENTS

| | | | |
|---|---|---|---|
| Des. 251,639 | 4/1979 | Colby | D6/368 |
| Des. 287,318 | 12/1986 | Garduno | D6/429 |
| 157,141 | 11/1874 | Stellmann | 5/98 X |
| 823,321 | 6/1906 | DeJonge | 5/98 C |
| 841,359 | 1/1907 | Trott | 5/98 X |
| 1,310,669 | 7/1919 | Morgan | 5/98 C |
| 1,426,160 | 8/1922 | Driver | 5/98 A |
| 1,582,756 | 4/1928 | Jennings | 5/98 X |
| 1,941,902 | 1/1934 | Lewis | 5/98 C |
| 2,014,904 | 9/1935 | Martin | 5/99 A |
| 2,369,885 | 2/1945 | Dobrenen | 5/98 X |
| 2,661,482 | 12/1953 | Zimov | 5/98 C |
| 3,839,754 | 10/1974 | Hooper | 5/98 A |
| 4,122,780 | 10/1978 | Brickman | D6/429 |
| 4,544,203 | 10/1985 | Younger et al. | D6/353 |

FOREIGN PATENT DOCUMENTS

| | | | |
|---|---|---|---|
| 548161 | 10/1922 | France | 5/98 C |

*Primary Examiner*—Alexander Grosz
*Assistant Examiner*—Eric K. Nicholson
*Attorney, Agent, or Firm*—Plante, Strauss & Vanderburgh

[57] ABSTRACT

There is disclosed a folding bed or diaper changing platform for an infant which has a pair of cross frame members pivotally interconnected to move between folded and unfolded positions. Each cross member and distally supports a longitudinal foot that extends to the corresponding, opposite frame member. The foot members are obtained at 45 degrees to the legs of the frame members, thereby forming a horizontal foot for enhanced stability of the furniture in its open or unfolded configuration and for assuming a spread stance in the folded position which, again, provides a stable configuration. The upper ends of the cross members distally support longitudinal upper rail members which, preferably, have a coextensive lip that is also oriented at 45 degrees to the plane of the longitudinal upper rail members. The conextensive lip members fixedly support snap receptacles for snap fasteners whereby a canopy can be removably attached to the furniture in its unfolded position. The coextensive lips also provide a spaced apart configuration to the furniture in the folded position, thereby providing for storage of items in the fabric mat of the bed when in its folded configuration.

11 Claims, 3 Drawing Sheets

PORTABLE INFANT FURNITURE

BACKGROUND OF THE INVENTION

1. Field of the Invention

This invention relates to portable infant furniture and, in particular, to a folding, portable bed, table, or cradle.

2. Brief Statement of the Prior Art

Folding furniture such as a folding hassock, stool, bed, etc., has been available in various forms for many years. Quite commonly, these various folding furniture elements employ pivotally engaged support braces extending from the seat or bed to subjacent feet.

One difficulty encountered with folding furniture which is of particular concern with infant furniture such as bassinets, beds and the like is that the open, useful position or the furniture is often quite unstable. The furniture should be sufficiently stable that it does not readily collapse or topple when it is in use, in the open position.

BRIEF DESCRIPTION OF THE INVENTION

This invention comprises a folding furniture, particularly a folding bed, platform or cradle for infants, which comprises a folding frame formed of end cross members which are pivotally interconnected at their central points, and which have upper longitudinal rails and lower longitudinal feet. Preferably, the longitudinal feet are disposed at an angle to the cross members, most preferably at 45°, whereby the feet are flat or horizontal and provide an expanded bearing surface for stability of the furniture in the open position. The feet of the furniture are also outwardly inclined when the furniture is in its folded position, providing a very stable support to the furniture in its folded configuration.

Preferably, the upper longitudinal rails are provided with coextensive lips which are also oriented at a similar angle, preferably 45°, to the cross members and assume a vertical position when the furniture is in its open position. In this manner, the lips on the upper longitudinal rails provide a vertical surface which supports fasteners, preferably snap fasteners, for the attachment of a removable canopy to provide protection against the elements.

Hand holds are provided in the form of elongated slots centrally located along the longitudinal upper members and the coextensive lips on these members meet in edge-to-edge abutment when the furniture is in its folded position, thereby providing a very convenient O hand hold for carrying the furniture and also spacing the frame members apart a sufficient distance that articles such as blankets, the portable canopy, etc., can be stored in the furniture in its folded position. A mat is supported across the furniture, between the longitudinal upper members, thereby providing support for an infant, when used as a bed or cradle, or as a platform for diaper changing.

BRIEF DESCRIPTION OF THE DRAWINGS

The invention will be described with reference to the FIGURES of which.

DESCRIPTION OF PREFERRED EMBODIMENTS

Figure 1:
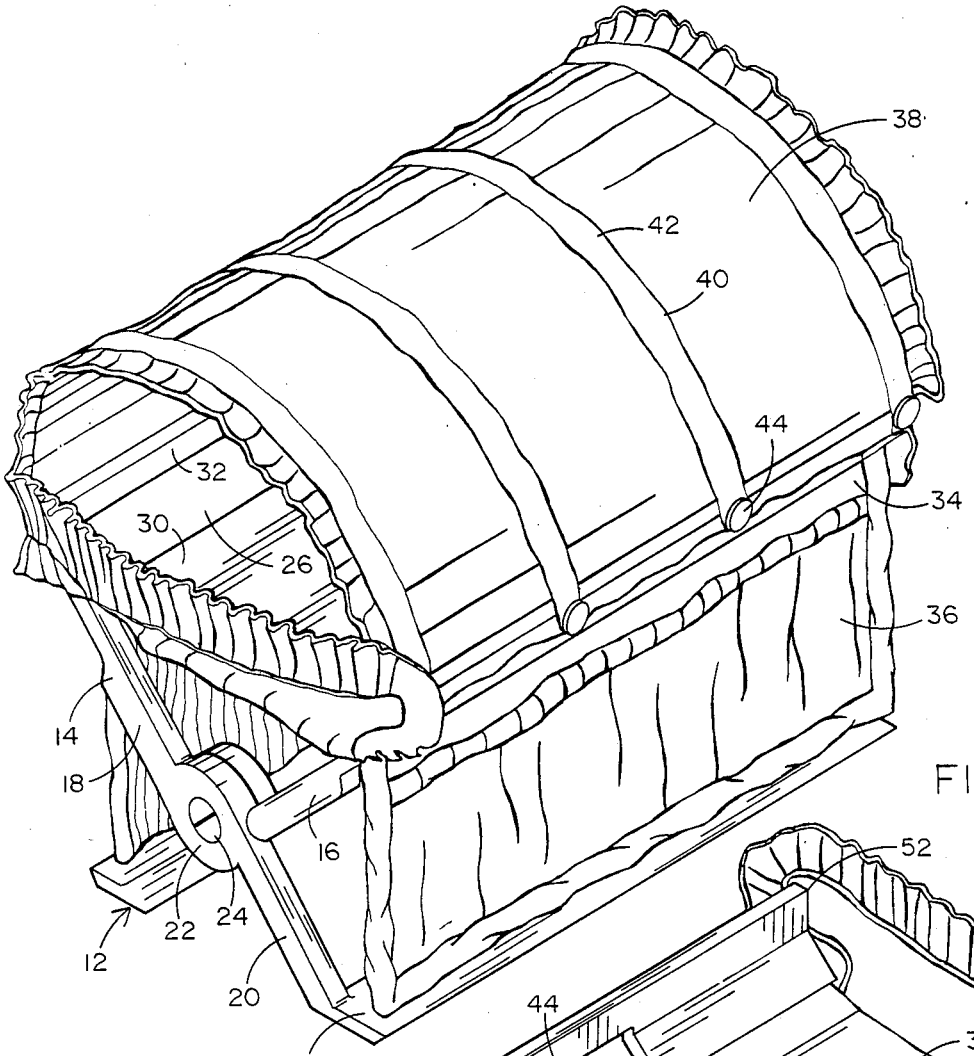
FIG. 1 is a perspective view of the infant furniture with the removable canopy.

Referring now to FIG. 1, the infant furniture of the invention comprises a folding frame that includes end cross members 12 which comprise a pair of cross arms 14 and 16. Each cross arm has a pair of coplaner legs 14 and 20 which depend from a central hub 22. The hubs 22 of the adjacent cross members are in juxtaposition and have a central, aligned aperture that receives an assembly pin 24 to provide pivotal interconnection of these cross members.

Disposed between the end cross members such as 12 are upper longitudinal rail members 26 and lower longitudinal foot members 28. The foot members 28 are disposed at an angular position to their supporting legs 20. In the illustrated embodiment, the cross members are oriented at right angles to each other in the open or unfolded configuration, and the longitudinal foot members 28 are, therefore, disposed at 45° angular inclination to the axis of their respective leg member 20. This angular position orients the longitudinal foot members 28 in a horizontal plane when the furniture is in its open, or unfolded, position which is shown in FIGS. 1–6.

A mat 30 is supported between the longitudinal rail members 26 and this mat is thus suspended between these members and provides a bed, or support for the infant when changing diapers.

Preferably, the upper longitudinal rail members 26 also have a coextensive lip 32 which, most preferably, is positioned at an angle to the surface of the longitudinal rail member 26. As illustrated, the upper longitudinal rail member 26 is coplaner with the plane of its respective leg 14. The coextensive lip 32 is oriented at an angle to the plane of the upper longitudinal rail member 26, most preferably at 45° thereto such that this lip 32 is vertically oriented when the furniture is in its unfolded or open position, as illustrated in FIGS. 1 and 2.

Each of the longitudinal rail members also supports a fabric web 34 which includes a plurality of pockets or pouches 36 which provide for storage of various and sundry items.

Superimposed on the furniture is a removable canopy 38 which includes a plurality of resilient support members 40 which can be of plastic or of metal to provide a resilient, arched support for the fabric used for canopy 38. These support members can be passed through channels 42 which are formed on the canopy by stitching or hems or can be adhesively bonded thereto. Each of the support members 40 distally supports fasteners 44 which, most preferably, are standard snap fasteners which coact with snap members carried on the longitudinal upper rails. While snap fasteners are preferred, and are illustrated, any other suitable fasteners such as Velcro fabric fasteners, buckles, etc., can also be used.

Figure 2:
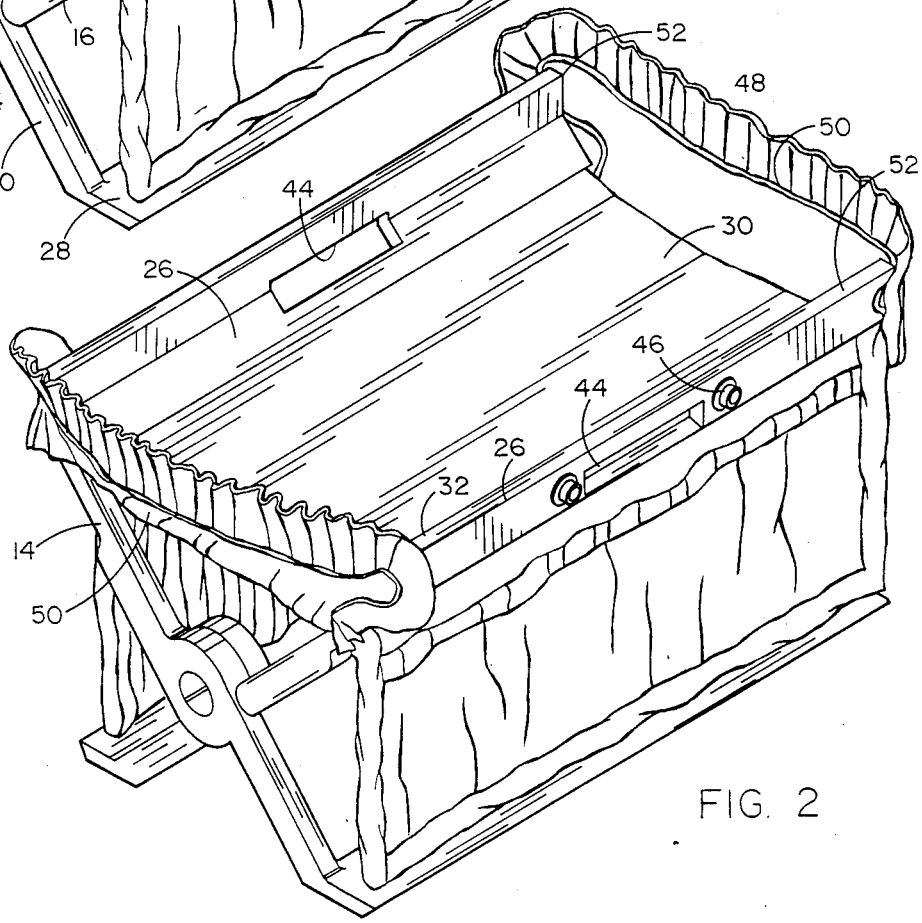
FIG. 2 is a perspective view of the infant furniture of the invention without the removable canopy.
Figure 3:
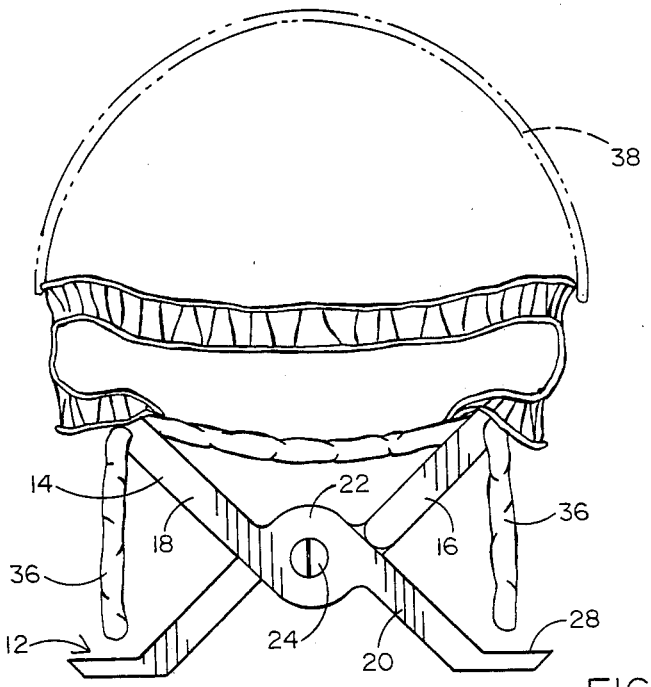
FIG. 3 is an end elevational view of the infant furniture.
Figure 4:
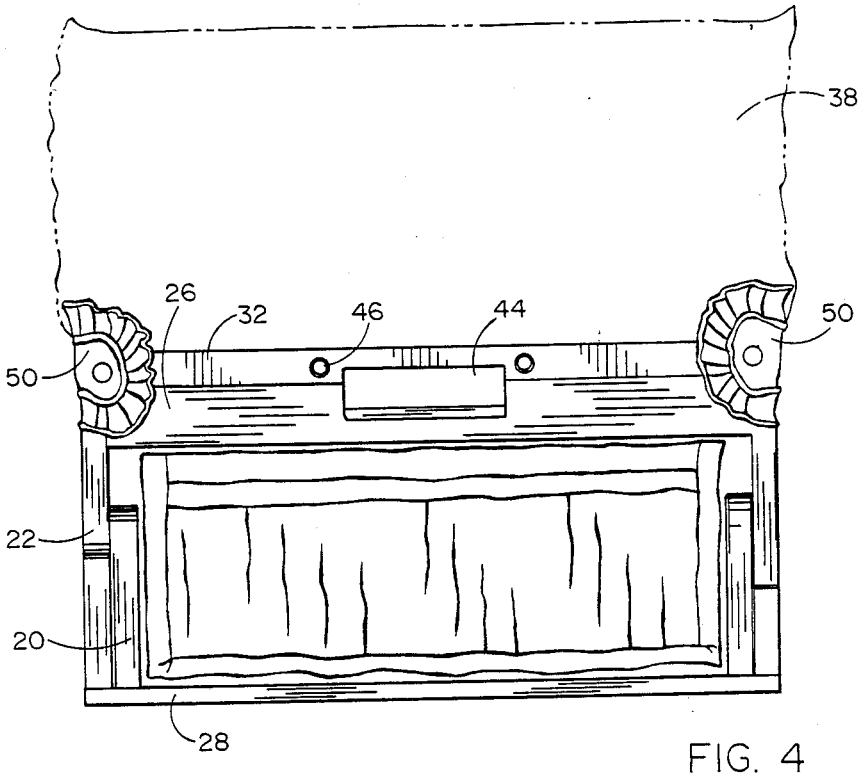
FIG. 4 is a side elevational view of the infant furniture.

Referring now to FIG. 2, the furniture is illustrated with the canopy 38 removed. As there illustrated, the longitudinal upper rails 26 are shown in full view, and can be seen to have hand holds 40 which are centrally located along their length. These hand holds are spaced identically on the members so as to be in alignment when the furniture is in its folded configuration. The upper longitudinal rail 26 shown in the foreground of FIG. 2 can be seen to have its coextensive lip 32 fixedly supporting the plurality of fasteners, preferably snap fastener receptacles 46 which coact with the snap fasteners 44 carried on the ends of the resilient canopy support members 40.

The mat 30 is preferably supported by a longitudinal member 48 which extends between the opposite legs 14 of the cross members.

Preferably, each end of the furniture has a fabric end member 50. The fabric end members are fixedly secured to the ends 52 of the longitudinal upper rail members 26 and are integral extensions of the mat 30, thereby closing the ends of the bed to prevent any infant from falling through the otherwise open end of the furniture.

Figure 5:
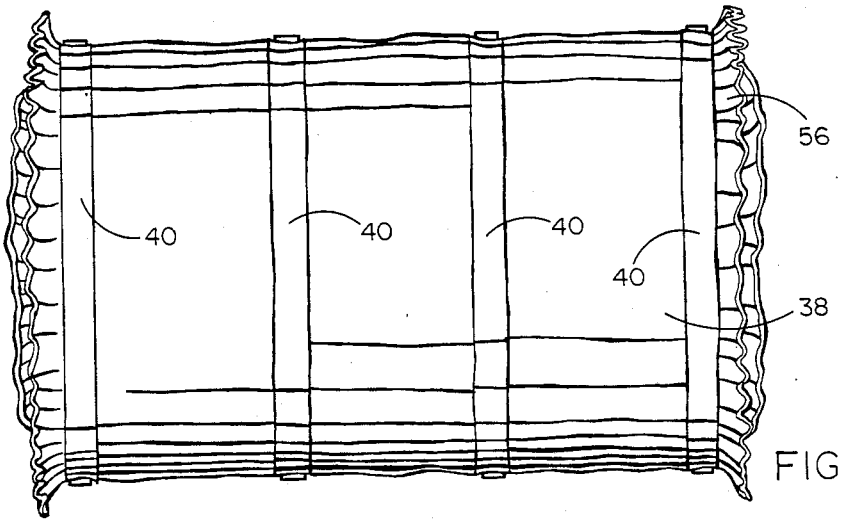
FIG. 5 is a top plan view of the furniture with the canopy.
Figure 6:
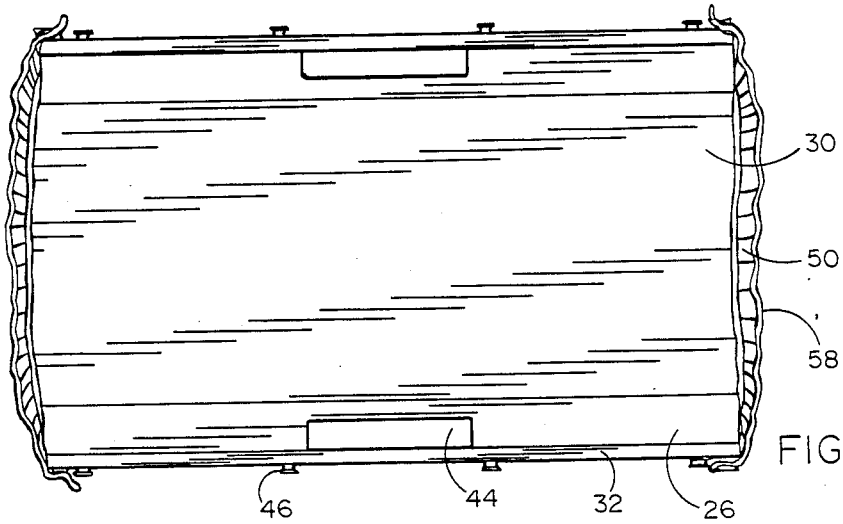
FIG. 6 is a top plan view of the furniture without the canopy.

Referring now to FIGS. 5 and 6, the top view of the furniture can be seen with and without the canopy. As illustrated, the canopy 38 is a fabric material which extends between the support members 40 and is fixedly secured to those members. At each end, the fabric can be gathered in a plurality of pleats 56 to provide a pleasing and decorative appearance. When the canopy is removed, access is provided to the entire bed formed by the fabric mat 30 with its end flaps 50. Again, the end flaps can be gathered in a plurality of pleats 58 to provide a pleasing appearance.

Figure 7:
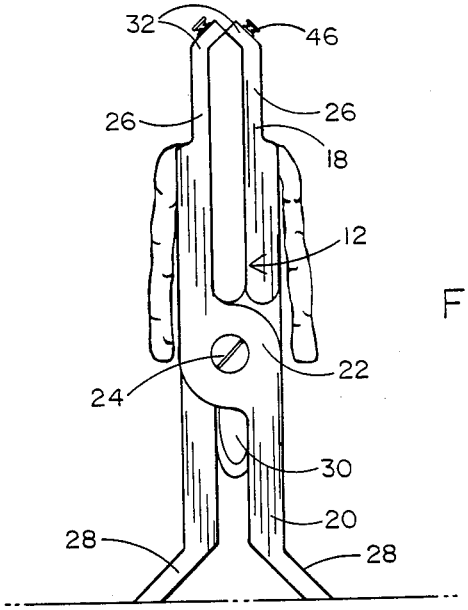
FIG. 7 is an end elevational view of the furniture in its folded position.

The furniture folds into a very compact and stable configuration. FIG. 7 illustrates an end view of the furniture in the folded configuration. In this configuration, the upper legs 14 of each of the cross frame members 12 are in a vertical position and the coextensive lips 32 which depend from the upper longitudinal rails 26 abut along a continuous line extending longitudinally of the furniture. The mating of these lip members provide an open space 60 between the longitudinal rail members 26 and between the entire frame. The mat 30 hangs between the lower legs 20 of the cross frame and this forms a pocket for storage of blankets, the canopy 38, and other articles. The longitudinal feet members 28 assume a spread configuration, open at their bases that imparts a very stable configuration. In this manner, the closed or folded configuration of the furniture can be conveniently stored or placed on the floor or a shelf and will resist toppling because of the open spread to the longitudinal foot members 28.

The pin 24 which pivotally engages the two cross members 14 and 16 is preferably threadably engaged with one of the longitudinal members so that when the members are in the folded configuration shown in FIG. 7, the pin 24 can be threaded into a tight lock of these members, firmly engaging the juxtapositioned hub members 22 and locking the frame members in the folded configuration.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. An infant bed foldable between unfolded and folded configuration, comprising:

a. a folding frame formed of:

(1) first and second end cross members at each end thereof which are centrally pivotally engaged;

(2) first and second upper rail members extending longitudinally between the upper ends of said cross members;

(3) first and second lowermost foot members, fixedly secured to and extending longitudinally between the lower ends of said cross members and at 45 degrees thereto, to spread outwardly when said bed is in its folded position and to assume a horizontal position when said bed is in its unfolded position, thereby stabilizing said bed in both folded and unfolded positions;

(4) first and second upper longitudinal lips, each having a centrally located elongated hand hold slot, coextensive with a respective one of said first and second upper rail members and dependent therefrom at 45 degrees thereto to assume a vertical position when said bed is in its unfolded position and to close inwardly and meet along respective inside upper edges and form a carrying handle when said bed is in its folded position; and b. a fabric mat extending between the supported by said longitudinal rail members.

2. The infant's bed of claim 1 including a canopy attached to and supported by said first and second lips.

3. The infant's bed of claim 2 including attachment means carried on said lips of said upper rails permitting removal and attachment of said canopy to said bed.

4. The infant's bed of claim 3 wherein said attachment means comprise a plurality of snap fasteners.

5. The infant's bed of claim 4 wherein said snap fasteners are carried on the laterally outside side of said lips.

6. The infant's bed of claim 1 whereby said longitudinal lips maintain said cross members and upper rail members spaced apart when said bed is in its folded position.

7. The infant's bed of claim 1 wherein each cross member includes opposite legs attached to a central hub member.

8. The infant's bed of claim 7 including a pin extending through and between said central hub members of each cross member, thereby providing their pivotal engagement.

9. The infant's bed of claim 8 including lock means to fixedly secure said cross members together in either of said folded or unfolded positions.

10. The infant's bed of claim 9 wherein said pin is threadably received in said joined central hub members.

11. The infant's bed of claim 1 including a fabric bag carried on the lower edge of at least one of said upper rails.

* * * * *